US006131369A

United States Patent [19]

Ausnit

[11] Patent Number: 6,131,369

[45] Date of Patent: Oct. 17, 2000

[54] METHOD OF APPLYING SLIDER TO PACKAGE HAVING RECLOSABLE ZIPPER

[75] Inventor: Steve Ausnit, New York, N.Y.

[73] Assignee: Illinois Tool Works Inc., Glenview, Ill.

[21] Appl. No.: 09/378,063

[22] Filed: Aug. 20, 1999

Related U.S. Application Data

[63] Continuation-in-part of application No. 09/177,212, Oct. 22, 1998, Pat. No. 6,000,197.

[51] Int. Cl.[7] ..... B65B 61/18

[52] U.S. Cl. ..... 53/412; 53/133.4; 53/139.2; 493/213; 493/214; 493/927

[58] Field of Search ..... 383/64; 493/212, 493/213, 214, 215, 927; 53/412, 451, 551, 133.4, 139.2

[56] References Cited

U.S. PATENT DOCUMENTS 3,633,642 1/1972 Siegel .
3,701,191 10/1972 Laguerve .
3,701,192 10/1972 Laguerve .
4,528,224 7/1985 Ausnit .
4,581,006 4/1986 Hughes et al. .
5,431,760 7/1995 Donovan .
5,557,907 9/1996 Malin et al. .
5,592,802 1/1997 Malin et al. .
5,956,924 9/1999 Thieman .
6,000,197 12/1999 Ausnit .

*Primary Examiner*—Daniel B. Moon
*Attorney, Agent, or Firm*—Pitney, Hardin, Kipp and Szuch LLP

[57] ABSTRACT

A method of making reclosable packages is provided. A package is formed from thermoplastic film. The package includes a reclosable zipper. The sides of the package are slit and spread apart. A slider is inserted on to the zipper through a side slit.

23 Claims, 3 Drawing Sheets

METHOD OF APPLYING SLIDER TO PACKAGE HAVING RECLOSABLE ZIPPER

CROSS-REFERENCE TO RELATED APPLICATIONS

This is a continuation-in-part of U.S. Ser. No. 09/177,212, filed on Oct. 22, 1998, now U.S. Pat. No. 6,000,197 the disclosure of which is incorporated herein by reference.

BACKGROUND OF THE INVENTION

1. Field of the Invention

The present invention relates to the field of reclosable packing. More particularly, the present invention relates to a method of applying a slider to a reclosable package formed on a form-fill-seal (FFS) machine.

2. Description of the Prior Art

Slide-zippers (i.e., reclosable zippers that are opened and closed by a cooperating slider) are well-known in the reclosable packaging art. Typical prior art slide-zippers are disclosed in U.S. Pat. Nos. 5,007,143, 5,008,971, 5,131,121 and 5,664,299.

Similarly, methods of making reclosable packages on FFS machines are also wellknown in the reclosable packaging art. Typical prior art methods of making reclosable packages on FFS machines are disclosed in U.S. Pat. Nos. 4,909,017, 4,655,862 and 4,894,975.

Because of the facility which is provided by slide-zippers to consumers of reclosable packages and because of the large volume of reclosable packages made on FFS machines today, it is highly desirable and advantageous to combine the two technologies so that slide-zippered packages can readily be made on FFS machines.

SUMMARY OF THE INVENTION

Accordingly, it is the object of the present invention to provide a new method of making slide-zippered packages on an FFS machine.

In accordance with the present invention, thermoplastic film having lengths of reclosable zipper attached transverse thereto at package length intervals is fed into an FFS machine. Each reclosable zipper length includes a pair of interlocking profiles, and each profile includes an interlocking member interlockable with the interlocking member of the other profile and a flange extending therefrom.

The film is fed downwardly over the FFS machine forming collar and around the FFS machine filling tube. The edges of the film are then sealed together by a pair of longitudinal seal bars to form a tube. As the film tube is indexed downwardly, a pair of blades slits the film tube adjacent the ends of the reclosable zipper lengths. A first pair of cross-seal bars then seals the flanges of the reclosable zipper lengths to opposing inside walls of the formed packages. The FFS machine is configured and the reclosable zipper lengths are oriented so that the zippers will be at the bottoms of the packages, rather than at the tops as with packages made on typical prior art FFS machines.

The interlocking members of the reclosable zipper lengths extend downwardly beyond the first pair of cross-seal bars. After the flanges are sealed, a vacuum in the bars is activated and applied to the film tube, causing the slit package walls to spread outwardly in the vicinity of the interlocking members. A slider insertion mechanism then inserts a slider on to the zipper through one of the package slits, which insertion is facilitated by the spreading of the package walls.

The vacuum is then released and a tamper evident seal is applied to the package by a second pair of cross-seal bars.

The present invention will now be described in detail, with frequent reference being made to the drawings identified below.

DETAILED DESCRIPTION OF THE PREFERRED EMBODIMENT

Figure 1:
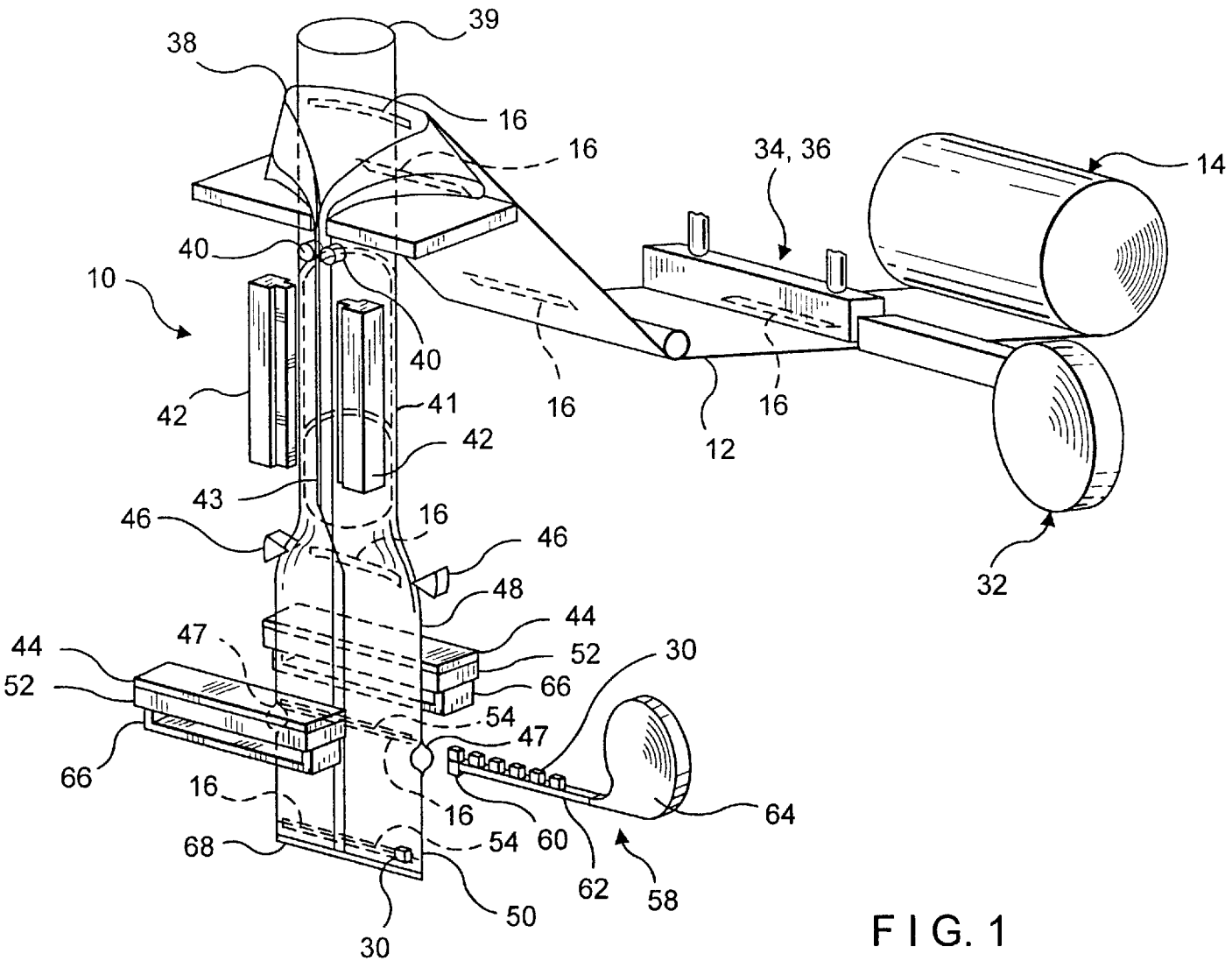
FIG. 1 is a perspective view of an FFS machine configured to make slide-zippered packages in accordance with the present invention.
Figure 2:
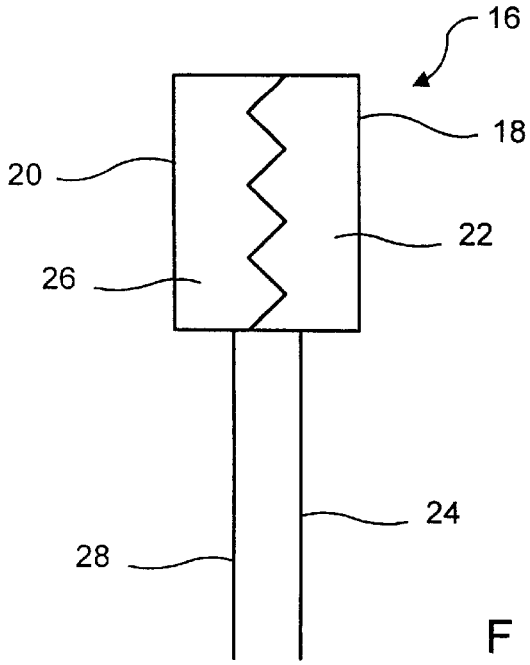
FIG. 2 is a cross-sectional view of a reclosable zipper in accordance with the present invention.

In accordance with the present invention, a vertical FFS machine 10 is shown in FIG. 1. Thermoplastic film 12 is paid off a continuous roll 14 in a running direction in increments equal to the length of packages which will be ultimately formed from the film 12 in the FFS machine 10. Each time the film 12 comes to rest locally, a length of reclosable zipper 16 made from a suitable plastic is disposed on the thermoplastic film 12 transverse to the running direction. As shown in FIG. 2, the reclosable zipper 16 includes a first profile 18 interlockable with a second profile 20. The first profile 18 includes an interlocking member 22 and a flange 24 extending therefrom. Similarly, the second profile 20 includes an interlocking member 26 and a flange 28 extending therefrom. The profile interlocking members 22, 26 are releasably engageable and are configured to cooperate with a slider 30 such that the slider 30 will open the zipper as it is moved along the interlocking members in an opening direction and close the zipper as it is moved along the interlocking members in a closing direction. The present invention is not limited to any particular zipper configuration and hence the zipper is depicted schematically. Likewise the present invention is not limited to any particular slider/zipper configuration and can be practiced with any configuration. The reclosable zipper lengths 16 are disposed on the thermoplastic film 12 transverse to the running direction with the zipper flanges 24, 28 projecting oppositely to the running direction and with one of the interlocking members above the other relative to the thermoplastic film 12.

As shown in FIG. 1, the reclosable zipper lengths 16 are supplied from a continuous roll 32. The zipper is pulled across the thermoplastic film 12 by a positioning device 34 which positions the reclosable zipper lengths 16 on the thermoplastic film 12 and cuts them from the continuous roll 32. The positioning device 34 can take any of a variety of forms well-known to those skilled in the reclosable packaging art, such as a vacuum conveyor for pulling the zipper 16 across the thermoplastic film 12 and a knife for cutting the zipper 16 from the continuous roll thereof 32.

As disclosed in U.S. Pat. No. 4,909,017, the disclosure of which is incorporated herein by reference, the reclosable zipper lengths 16 have a length approximately equal to half the width of the thermoplastic film 12 and are disposed centrally thereon. A sealing mechanism 36, such as a pair of seals bars, seals the lower zipper flange, either as a full seal or as a tack seal, to the thermoplastic film 12.

Because the reclosable zipper lengths 16 are attached to the thermoplastic film 12 with their flanges projecting oppositely to the running direction of the film, the FFS machine is configured make packages having zippers at their bottoms, rather than at their tops. Of course, during use by consumers the packages will be inverted so that the package bottoms effectively become the package tops.

As shown in FIG. 1, the thermoplastic film 12 with the reclosable zipper lengths 16 attached thereto is fed downwardly over a forming collar 38 and folded around the filling tube 39 of the FFS machine 10. The edges of the film are brought together by a pair of rollers 40 and welded together by a pair of longitudinal seal bars 42 to form a film tube 41 having a longitudinal back seal 43.

Then, as the film tube 41 is indexed downwardly, a pair of blades 46 slits the sides of the film tube 41 adjacent the ends of the reclosable zipper lengths 16. The slits 47 extend downwardly beyond the zipper interlocking members 22, 26, as shown in FIGS. 1 and 4. These blades 46 may optionally be placed adjacent the second pair of cross-seal bars 66, as illustrated in FIG. 3 (46'), but are preferably located upstream thereof.

If the packages are to be filled, a pair of pinch bars 44 is provided which pinches the film tube 41 in order to keep the package contents from contaminating the cross-seal area, as shown in FIG. 4. After optional filling, the bottom of the package presently being formed 48 (which will effectively be the top of the package 48 during use) and the top of the preceding package 50 (which will effectively be the bottom of the package 50 during use) are completed.

Figure 3:
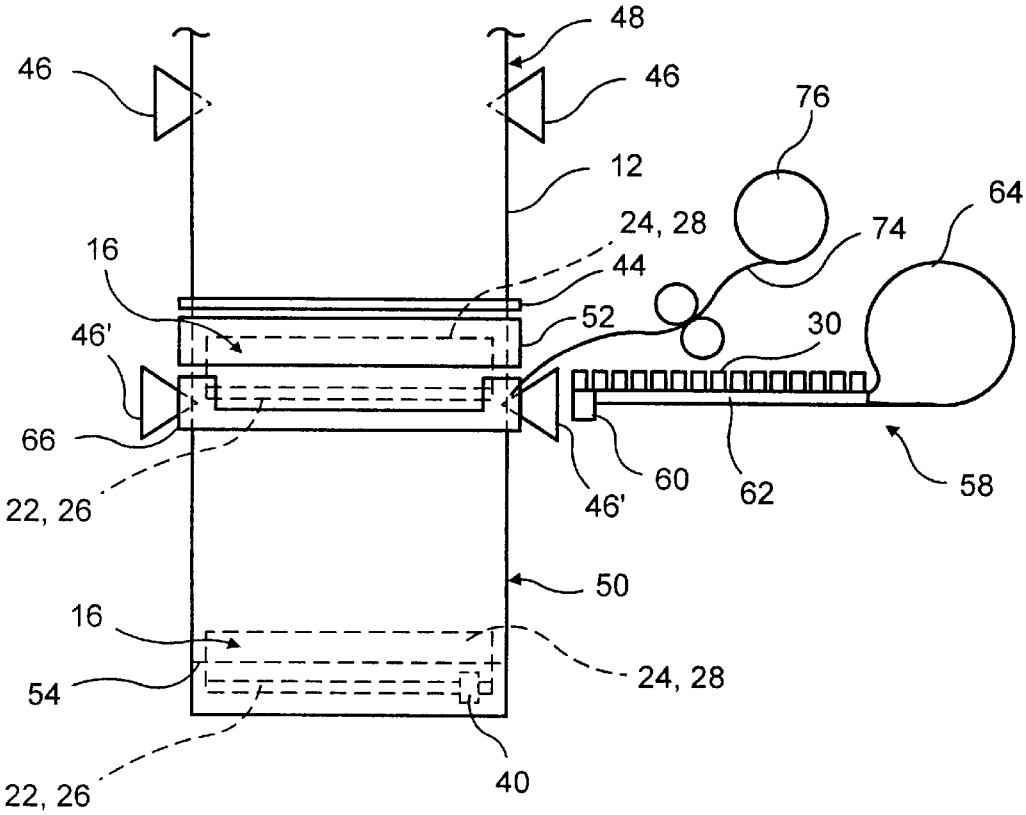
FIG. 3 is a front view of the cross-seal bars and slider insertion mechanism of the FFS machine of FIG. 1.
Figure 4:
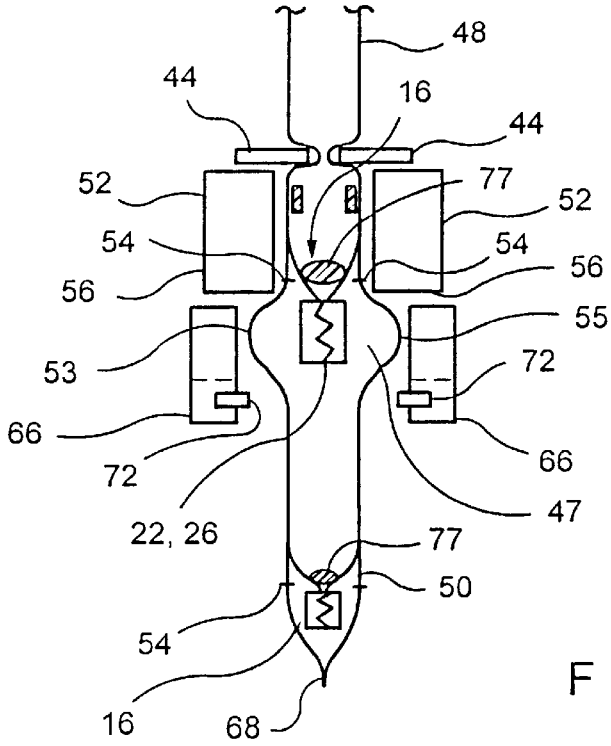
FIG. 4 is a cross-sectional view of a reclosable zipper being sealed to opposing package walls in the FFS machine of FIG. 1.
Figure 5:
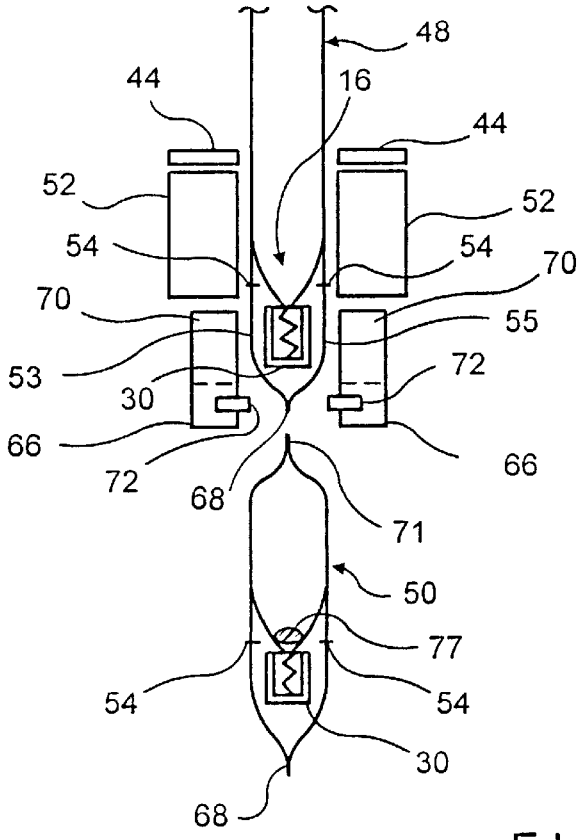
FIG. 5 is a cross-sectional view of the package of FIG. 4 after slider insertion.

First, as shown in FIGS. 3–5, a first pair of cross-seal bars 52 seals the zipper flanges 24, 28 to the interior surfaces of the opposing package walls 53, 55. If one of the zipper flanges was only tack sealed to the thermoplastic film 12 by the sealing mechanism 36, it is now permanently sealed. If that flange was permanently sealed to the thermoplastic film 12 by the sealing mechanism 36, however, then only the unsealed flange needs to be sealed. Additionally, a portion of the first pair of cross-seal bars 52 is configured to perforate the package walls 53, 55 across the width of the package. These perforations 54 will enable the package user to tear off the bottom of the package and gain access to the zipper 16.

After the first pair of cross-seal bars 52 seals the zipper flange(s) to the package walls, a vacuum from a source 56 located in the lower side of the bars 52 or in the second pair of seal bars 66 is activated, drawing the package walls 53, 55 apart adjacent the zipper interlocking members 22, 26. A slider insertion mechanism 58 then inserts a slider 30 made from a suitable plastic on to the interlocking members 22, 26, which insertion is made possible by the spreading of the package walls. The zipper flanges may be secured by a peel seal strip 77 which insures the integrity of a filled package until such time as the package is initially opened by a consumer. The peel seal 77 is above the zipper strip 16 during the bag formation as illustrated in FIG. 4. This results in the peel seal being below the zipper when the bag in re-oriented so that the zipper is on the bag top.

The slider insertion mechanism 58 includes a slider disengager 60, which disengages the sliders if they are linked, and a laterally moving slider loading arm 62, which laterally extends to load a slider 30 on to the interlocking members 22, 26 and then retracts. The loading arm may also incorporate a lifting mechanism to insert the slider on the fastener. If the sliders 30 are not linked to each other, the slider disengager 60 serves to hold the remaining sliders back as the loading arm 62 extends laterally to load a slider on to the interlocking members. The sliders are preferably supplied from a coil of interconnected sliders 64, although they may be supplied from any appropriate mechanism, including a cartridge or a vibrating hopper.

After slider insertion, the vacuum is released. If necessary, air is blown on the package walls 53, 55 to return them to position. A second pair of cross-seal bars 66 then creates a tamper evident seal 68 below the zipper by sealing the package walls 53, 55 to each other below the zipper. Optional vertical extensions 70 on the second pair of cross-seal bars 66 seal the interlocking members 22, 26 together at their ends to form end stops for the slider 30 and if desired can also seal the side slits 47. The second pair of cross-seal bars 66 also seals the top 71 of the preceding package 50 and cuts the completed preceding package 50 from the remainder of the thermoplastic film 12 by means of a pair of blades 72 inserted into the bars 66.

Optionally, the second pair of cross-seal bars 66 may be configured to perforate the package walls instead of the first pair of cross-seal bars 52. However, because the perforations will be below the zipper, after the package user tears the bottom of the package off to obtain access to the slider and zipper, there will be a pair of package wall extensions which will have to separated by the user every time the user desires to open or close the package. Thus, it is preferable that the perforations be made by the first pair of cross-seal bars above the interlocking members. Also optionally, a tear away plastic strip or string 74 may be introduced from a coil 76 and sealed to the package, as shown in FIG. 3.

Optionally also, the second pair of cross-seal bars 66 may be separated vertically into two pairs of upper and lower cross seal bars with the lower bars operating first to seal the top 71 of a preceding bag and the upper bars forming the tamper evident seal 68 below the zipper of the current bag after the slider insertion mechanism has acted. In this way the opposed walls act as a skirt and are easier to spread.

To access and open the completed package 50, the user inverts the package so that the zipper is at the top, tears off the tamper evident seal 68 along the perforations 54, and moves the slider 30 in the opening direction to separate the zipper interlocking members.

It should be realized that the present invention is not limited to slider insertion, but can be used to insert and seal a reclosable zipper to a package if desired. Additionally, the present invention is not limited to FFS machines, but may be practiced on any type of package making apparatus.

Thus, in the foregoing manner the object of the present invention is achieved. Modifications to the above would be obvious to those of ordinary skill in the art, but would not bring the invention so modified beyond the scope of the appended claims.

What is claimed is:

1. A method of making packages, said method comprising the steps of:

providing thermoplastic film, said thermoplastic film having a length of reclosable zipper attached thereto;

forming a package from said thermoplastic film, said package having opposing walls joined by opposing sides;

slitting one of said package sides adjacent said reclosable zipper length to form a side slit;

sealing said reclosable zipper length to the inner surface of at least one of said package walls;

spreading said package walls apart at said side slit; and inserting a slider on to said reclosable zipper length through said side slit, said slider being adapted to open the zipper as it is moved along the zipper in an opening direction and to close the zipper as it is moved along the zipper in a closing direction.

2. The method according to claim 1 including the additional steps of:

sealing said package walls together to form a bottom of said package; and sealing said package walls together to form a top of said package.

3. The method according to claim 1 including the additional step of sealing the ends of said reclosable zipper length to form end stops for said slider.

4. The method according to claim 1 wherein said slitting step occurs after said zipper sealing step.

5. The method according to claim 1 wherein said reclosable zipper length is attached to said thermoplastic film transverse to a running direction of said thermoplastic film.

6. The method in accordance with claim 5 wherein said package is formed as said thermoplastic film moves vertically and a package bottom is formed downstream of said reclosable zipper length and comprising the further step of filling said package from above said package bottom prior to sealing said package walls to form a top of said package and subsequent to forming said package bottom.

7. The method according to claim 1 wherein both package sides are slit.

8. The method in accordance with claim 1 wherein said length of reclosable zipper comprises a pair of interlocking profiles, each profile having attached thereto a flange directed away from a bottom of the package being formed and comprising the additional steps of:

sealing a portion of each of said flanges to an associated one of said opposing walls; and perforating each of said walls but not its associated zipper flange between said package bottom and flange sealing portion.

9. The method in accordance with claim 1 wherein said length of reclosable zipper comprises a pair of interlocking profiles, each profile having attached thereto a flange directed away from a bottom of the package being formed, said flanges being joined by a peel seal.

10. The method in accordance with claim 1 wherein said reclosable zipper length comprises a pair of interlocking profiles, each of said profiles having an interlocking member and a flange attached thereto extending from only one side of said interlocking member and comprising the further step of moving said thermoplastic film in a direction from said flanges toward said interlocking members.

11. A method of making packages, said method comprising the steps of:

providing thermoplastic film, attaching at least one reclosable zipper length to said thermoplastic film;

folding said thermoplastic film so as to bring its longitudinal edges together;

sealing said longitudinal edges together to form a package having opposing walls joined by opposing sides and one reclosable zipper length;

slitting one of said package sides adjacent said one reclosable zipper length to form a side slit;

sealing said one reclosable zipper length to the inner surface of at least one of said package walls;

spreading said package walls apart at said side slit; and inserting a slider on to said one reclosable zipper length through said side slit, said slider being adapted to open the zipper as it is moved along the zipper in an opening direction and to close the zipper as it is moved along the zipper in a closing direction.

12. The method according to claim 11 wherein said at least one reclosable zipper length is attached to said thermoplastic film transverse to a running direction of said thermoplastic film.

13. The method in accordance with claim 12 wherein said package is formed as said thermoplastic film moves vertically and a package bottom is formed downstream of said reclosable zipper length and comprising the further step of filling said package from above said package bottom prior to sealing said package walls to form a top of said package and subsequent to forming said package bottom.

14. The method in accordance with claim 12 wherein said reclosable zipper length comprises a pair of interlocking profiles, each of said profiles having an interlocking member and a flange attached thereto extending from only one side of said interlocking member and comprising the further step of moving said thermoplastic film in a direction from said flanges toward said interlocking members.

15. The method according to claim 11 including the additional step of sealing said package walls to form the bottom of the package and the top of a preceding package.

16. The method in accordance with claim 15 wherein said inserting step occurs after forming the top of said preceding package and prior to forming the bottom of the package.

17. The method according to claim 15 including the additional step of cutting said preceding package from said package.

18. The method according to claim 17 including the additional step of sealing said package walls to form the top of the package and the bottom of a succeeding package.

19. The method according to claim 11 including the additional step of sealing the ends of said one reclosable zipper length to form end stops for said slider.

20. The method according to claim 11 wherein said slitting step occurs after said zipper sealing step.

21. The method according to claim 11 wherein both package sides are slit.

22. The method in accordance with claim 11 wherein said length of reclosable zipper comprises a pair of interlocking profiles, each profile having attached thereto a flange directed away from a bottom of the package being formed and comprising the additional steps of:

sealing a portion of each of said flanges to an associated one of said opposing walls; and perforating each of said walls but not its associated zipper flange between said package bottom and flange sealing portion.

23. The method in accordance with claim 11 wherein said length of reclosable zipper comprises a pair of interlocking profiles, each profile having attached thereto a flange directed away from a bottom of the package being formed, said flanges being joined by a peel seal.

* * * * *